US008757237B2

(12) United States Patent
Aoki

(10) Patent No.: US 8,757,237 B2
(45) Date of Patent: Jun. 24, 2014

(54) BLIND

(75) Inventor: Takaaki Aoki, Tokyo (JP)

(73) Assignee: Nichibei Co., Ltd., Chuo-Ku, Tokyo (JP)

( * ) Notice: Subject to any disclaimer, the term of this patent is extended or adjusted under 35 U.S.C. 154(b) by 137 days.

(21) Appl. No.: 13/639,799

(22) PCT Filed: Mar. 23, 2011

(86) PCT No.: PCT/JP2011/056960

§ 371 (c)(1),
(2), (4) Date: Oct. 24, 2012

(87) PCT Pub. No.: WO2011/129181

PCT Pub. Date: Oct. 20, 2011

(65) Prior Publication Data

US 2013/0056162 A1 Mar. 7, 2013

(30) Foreign Application Priority Data

Apr. 14, 2010 (JP) ..... 2010-093459

(51) Int. Cl.
*A47H 1/00* (2006.01)

(52) U.S. Cl.
USPC ..... 160/120; 192/48.91; 192/48.92

(58) Field of Classification Search
USPC ..... 160/87, 89, 108, 115, 120; 192/48.81, 192/48.92, 114 R, 69.81, 89.27, 89.21
See application file for complete search history.

(56) References Cited

U.S. PATENT DOCUMENTS

| | | | | |
|---|---|---|---|---|
| 6,339,977 | B1 * | 1/2002 | Lee et al. | 81/58.3 |
| 2006/0027339 | A1 * | 2/2006 | Hsu | 160/120 |
| 2011/0061821 | A1 * | 3/2011 | Kim | 160/305 |
| 2013/0056162 | A1 * | 3/2013 | Aoki | 160/87 |
| 2013/0098563 | A1 * | 4/2013 | Jang | 160/120 |
| 2013/0098564 | A1 * | 4/2013 | Jang | 160/120 |
| 2013/0240156 | A1 * | 9/2013 | Jang | 160/120 |
| 2013/0306250 | A1 * | 11/2013 | Mullet et al. | 160/120 |

FOREIGN PATENT DOCUMENTS

| | | |
|---|---|---|
| JP | 04-080492 A | 3/1992 |
| JP | 2004-080492 | 3/1992 |
| JP | 2010-176471 | 6/1998 |
| JP | 2004-016422 | 1/2004 |
| JP | 2004-016423 | 1/2004 |

* cited by examiner

*Primary Examiner* — Katherine Mitchell
*Assistant Examiner* — Scott Denion
(74) *Attorney, Agent, or Firm* — Miller, Matthias & Hull LLP

(57) ABSTRACT

In a blind with two shields, it is possible to perform different operations by operating one operating means and reduce the dimension of an operating device by reducing the number of parts. The operating device comprises an operating shaft rotated upon receiving an operation force, a clutch rotating integrally with the operating shaft and axially sliding on the operating shaft, and a first transmission member 50 and a second transmission member disposed at both axial sides of the clutch to transmit driving force to a first driving shaft and a second driving shaft, respectively. The sliding direction of the clutch is determined by the rotational direction of the operating shaft, such that as the clutch sliding on the operating shaft is engaged with one of the transmission members and, the rotation of the operating shaft is transmitted to any one of the driving shafts and through one of the transmission members and.

5 Claims, 8 Drawing Sheets

BLIND

CROSS-REFERENCE TO RELATED APPLICATIONS

This application is a U.S. national stage filing of International Patent Application No. PCT/JP2011/056960 filed on Oct. 14, 2011, which claims priority under the Paris Convention to Japanese Patent Application No. 2010-093459, filed on Apr. 14, 2010.

FIELD OF THE DISCLOSURE

The present invention relates to a blind with two shields, which can perform different operations by operating one operating means.

BACKGROUND OF THE DISCLOSURE

Conventionally, as this kind of blind, the blind disclosed in Patent publication 1 has been known. The blind includes first and second lifting/lowering units, first and second stopper units that are capable of selecting one of a state of preventing first and second solar radiation shields from being lowered by their own weights and a state of allowing the solar radiation shields to be lowered by their own weights, a first clutch unit that is capable of selecting an operation of the first solar radiation shield without lifting/lowering the second solar radiation shield from an operation of lifting the first solar radiation shield, an operation of lowering the first solar radiation shield due to its own weight, and an operation of preventing lowering the first solar radiation shield due to its own weight, by operating both first lifting/lowering unit and the first stopper unit in accordance with an operation in one direction of an operation cord, and a second clutch unit that is capable of selecting an operation of the second solar radiation shield without lifting/lowering the first solar radiation shield from an operation of lifting the second solar radiation shield, an operation of lowering the second solar radiation shield due to its own weight, and an operation of preventing lowering the second solar radiation shield due to its own weight, by operating the second lifting/lowering unit and the second stopper unit in accordance with an operation in the other direction of the operating cord.

The first and second clutch units are disposed at front and rear respectively in parallel with each other in a head box and driving force is transmitted to the first and second clutch units from driving gears disposed under the clutch units.

When a room side of the vertically hanging operation cord is pulled down, the first solar radiation shield can be lifted, and when the operating cord is released after lifting the first solar radiation shield to a desired position, lowering of the first solar radiation shield due to its own weight is prevented and thus the hanging first solar radiation shield is maintained at the desired position. In order to lower the first solar radiation shield, slightly pulling down the room side of the vertically hanging operation cord allows the first solar radiation shield to drop by its own weight.

Further, when a window side of the vertically hanging operation cord is pulled down, the second solar radiation shield can be lifted, and when the operating cord is released after lifting the second solar radiation shield to a desired position, lowering of the second solar radiation shield due to its own weight is prevented and thus the hanging second solar radiation shield is maintained at the desired position. In order to lower the second solar radiation shield, slightly pulling down the window side of the vertically hanging operation code allows the second solar radiation shield to drop by its own weight.

As described the above, it is possible to lift/lower the first solar radiation shield and the second solar radiation shield by operating the operation cord vertically hung on the room side and the outside, respectively, and it is possible to independently lift/lower the first solar radiation shield and the second solar radiation shield by operating the single operation cord.

SUMMARY OF THE DISCLOSURE

However, switchover between the operations of the first and second clutch units is performed by moving components in an axial direction in the blind described above and the first and second clutch units having the components are disposed at front and rear respectively in parallel with each other in the head box. That is, since one clutch unit is provided for each solar radiation shield, problems are that the number of parts increases and the size for accommodating the entire operation device increases.

The present invention has been made to solve the problems, and an object of the present invention is to provide a blind having an operation device that is capable of performing different operations with one single operating means with a small number of parts in a small dimension.

To solve the above-described problems, a blind according to the present invention includes, a first shield under a pressure that urges the first shield in any one direction of a lifting direction and a lowering direction, a second shield under a pressure that urges the second shield in any one direction of a lifting direction and a lowering direction, a first driving shaft rotatably supported and connected to the first shield such that its rotational direction corresponds to lifting/lowering of the first shield, a second driving shaft rotatably supported and connected to the second shield such that its rotational direction corresponds to lifting/lowering of the second shield, a first stopper capable of shifting between a state of allowing rotation of the first driving shaft in the urged direction of the first shield and a state of restricting the rotation of the first driving shaft, and a second stopper capable of shifting between a state of allowing rotation of the second driving shaft in the urged direction of the second shield and a state of restricting the rotation of the second driving shaft. It comprises an operating shaft capable of rotating upon receiving an operation force, a clutch capable of rotating integrally with the operating shat and axially sliding on the operating shaft, a first transmission member disposed at one axial side of the clutch to transmit driving force to the first driving shaft, and a second transmission member disposed at the other axial side of the clutch to transmit driving force to the second driving shaft, and wherein the sliding direction of the clutch is determined by the rotational direction of the operating shaft, such that as the clutch sliding on the operating shaft is engaged with one of the transmission members, the rotation of the operating shaft is transmitted to any one of the driving shafts through one of the transmission members.

As the operating shaft is operated to rotate in any one direction, the transmission member to which rotation is transmitted is switched by the sliding direction of the clutch which is determined in accordance with the rotational direction of the operating shaft, such that the rotation is transmitted to any one of driving shafts through one of the transmission member.

Further, ratchet protrusions are formed on both axial sides of the clutch, a ratchet protrusion is formed at the first transmission member, said protrusion being adapted to be engaged with the protrusion on one side of the clutch only when the clutch rotates in one direction, a ratchet protrusion is formed at the second transmission member, said protrusion being adapted to be engaged with the protrusion on the other side of the clutch only when the clutch rotates in the other direction, and the protrusions of the clutch are adapted to be axially pushed in contact with the protrusion of one of the transmission members and engaged with the protrusion of the other transmission member, in accordance with the rotational direction. When the clutch axially slides on the operating shaft, the ratchet protrusions of the clutch and one of the transmission members come in contact with each other while rotating, such that the clutch is pushed toward the other transmission member by one transmission member and engaged with the other transmission member, thereby ensuring shifting of the clutch.

A plurality of grooves extending around an outer circumferential surface of the clutch are formed axially adjacent to each other, a coupler is adapted to be fitted in one of the grooves, the position of said coupler being fixed with respect to the operating shaft and the coupler transits from one of the grooves across an interface between the adjacent grooves to be fitted into the other groove when the clutch slides on the operating shaft. Since the coupler of which the position is fixed with respect to the operating shaft is fitted into one of the grooves formed adjacent to each other in the axial direction of the clutch, the axial movement of the clutch is restricted and the axial position of the clutch to the operating shaft can be firmly maintained.

Further, at least one transmission member of the first and second transmission members is biased in the direction in which the transmission member is engaged with the clutch by an urging member. Therefore, in switching, since the transmission members can move in the direction temporarily separate from the clutch against the urging member, the transmission members and the clutch are prevented from locking to each other and the rotation and axial movement of the clutch can be ensured.

Further, an endless operating cord is provided to apply operational force to the operating shaft. When the shield is lifted/lowered by rotating the driving shaft, the operating cord may be moved through the corresponding transmission member, the clutch, and the operating shaft. Therefore, in order to stop the operation of the shield, an operator can operate the operating cord, which is moving, in the direction to stop moving, such that the operator can instantly and intuitively determine the operation direction to operate, without confusing the operation direction.

According to the present invention, since it is possible to perform a switchover with one clutch, it is possible to reduce the number of parts of the operating device and the size for accommodating the operating device.

DETAILED DESCRIPTION

Embodiments of the present invention will be described hereafter with reference to the drawings.

Figure 1:
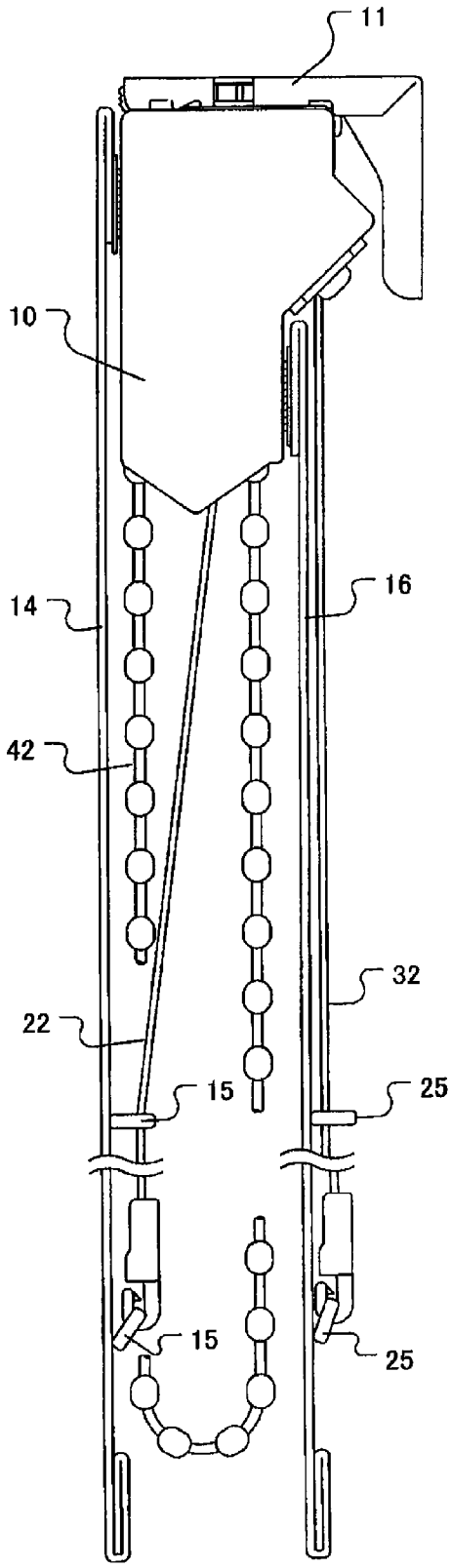
FIG. 1 is a side view of a blind according to an embodiment of the present invention.
Figure 2:
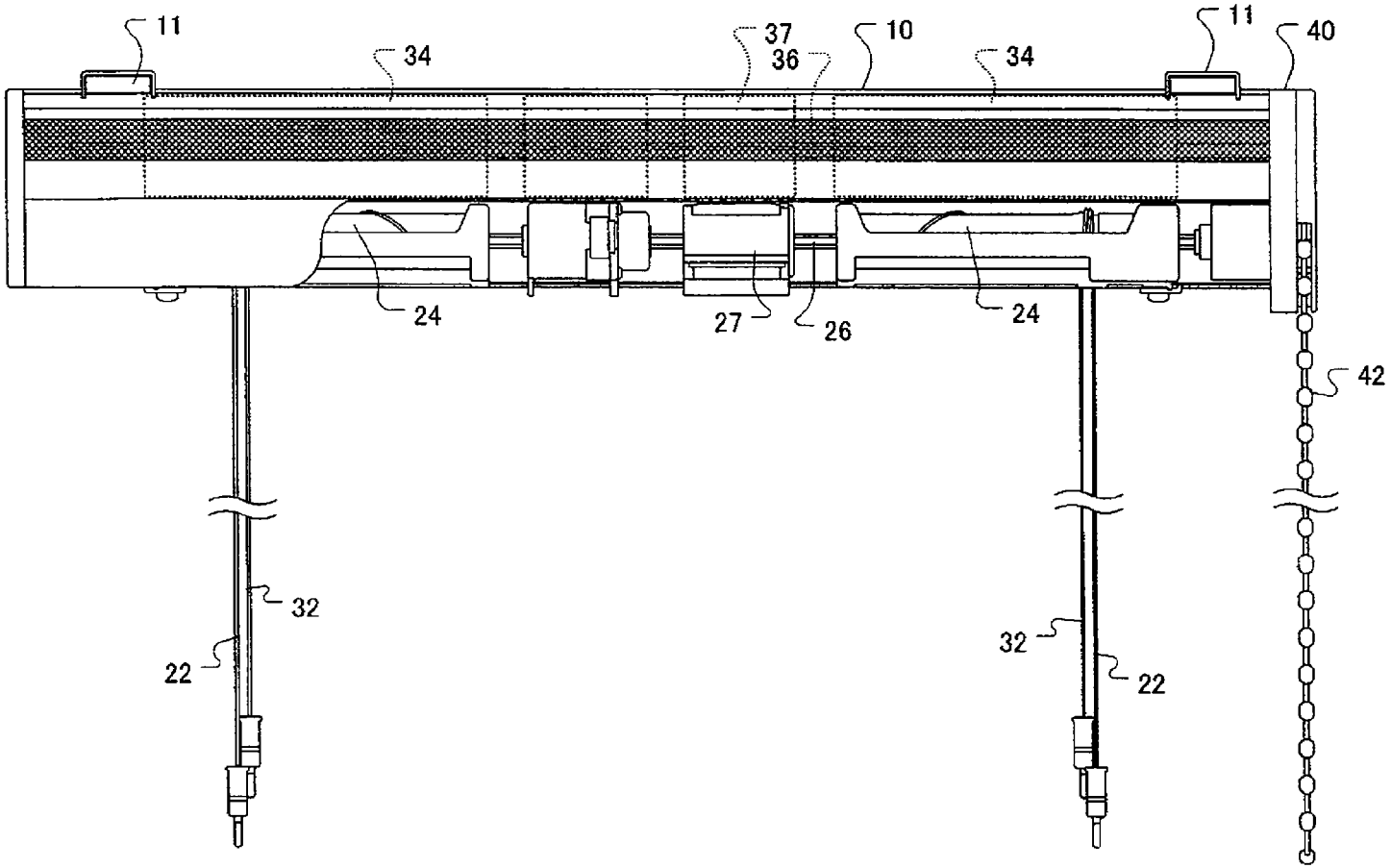
FIG. 2 is a front view of FIG. 1 (shields being not shown).
Figure 3:
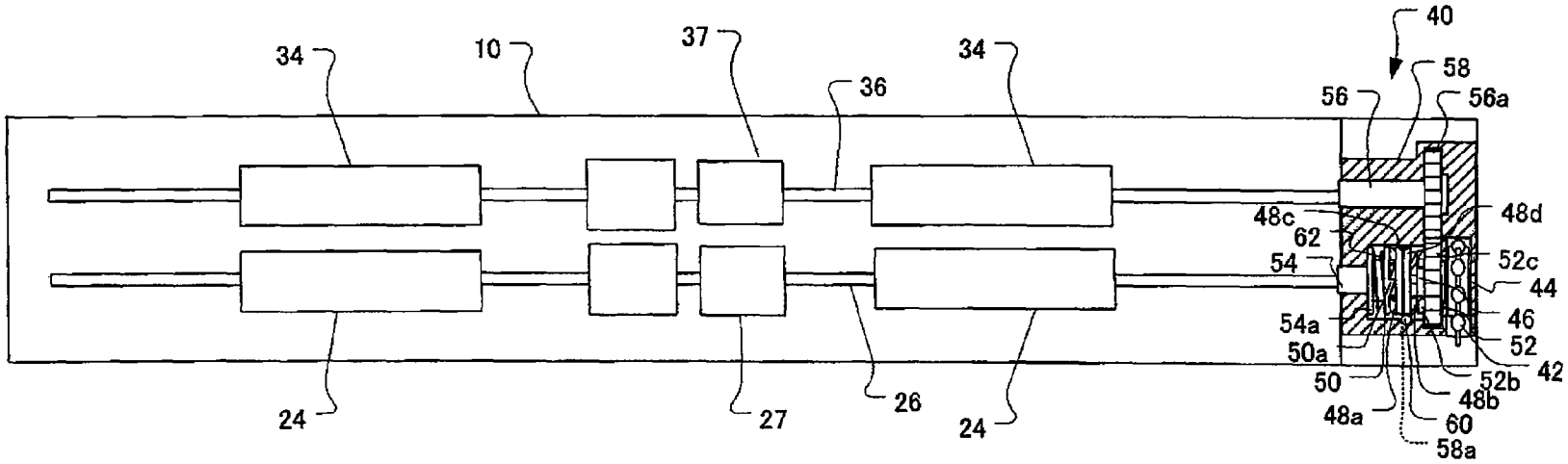
FIG. 3 is a plan view schematically showing the arrangement of members in a head box.

Referring to FIGS. 1 to 3, reference numeral 10 indicates a head box that is fixed to a window frame, a wall or the like with a bracket 11 and upper ends of a first shield 14 and a second shield 16 are attached to the head box 10.

A first lifting/lowering cord 22 is hung from the head box 10 so as to move vertically and passes through several cord rings 15 spaced apart at predetermined intervals in a vertical direction along the first shield 14 on the rear side of the first shield 14 so that one end of the first lifting/lowering cord 22 is connected to the lowermost cord ring 15. The other end of the first lifting/lowering cord 22 is connected to a first winding drum 24 which is rotatably supported, to be wound around and unwound from the drum 24 in the head box 10, and a first driving shaft 26 is connected to the first winding drum 24 to be rotated together with the first winding drum 24. The first shield 14 is urged to go down by its own weight, and a first stopper 27 is provided with the first driving shaft 26. The first stopper 27 can shift between a state allowing the first driving shaft 26 to rotate in the unwinding direction of the first lifting/lowering cord 22 which corresponds to the lowering direction of the first shield 14 and a state preventing the rotation of the first driving shaft 26.

Similarly, a second lifting/lowering cord 32 is hung from the head box 10 so as to move vertically and passes through several cord rings 25 spaced apart at predetermined intervals in a vertical direction along the second shield 16 on the rear side of the second shield 16 so that one end of the second lifting/lowering cord 32 is connected to the lowermost cord ring 25. The other end of the second lifting/lowering cord 32 is connected to a second winding drum 34 which is rotatably supported, to be wound around and unwound from the drum 34 in the head box 10, and a second driving shaft 36 is connected to the second winding drum 34 to be rotated together with the second winding drum 24. The second shield 16 is urged to go down by its own weight, and a second stopper 37 is provided with the second driving shaft 36. The second stopper 37 can shift between a state allowing the second driving shaft 36 to rotate in the unwinding direction of the second lifting/lowering cord 32 which corresponds to the lowering direction of the second shield 16 and a state preventing the rotation of the second driving shaft 36.

The first driving shaft 26 and the second driving shaft 36 extend in parallel with each other in the head box 10 and one end of each of the driving shafts are connected to an operating unit (an operating device) 40 disposed at one end of the head box 10.

Figure 4:
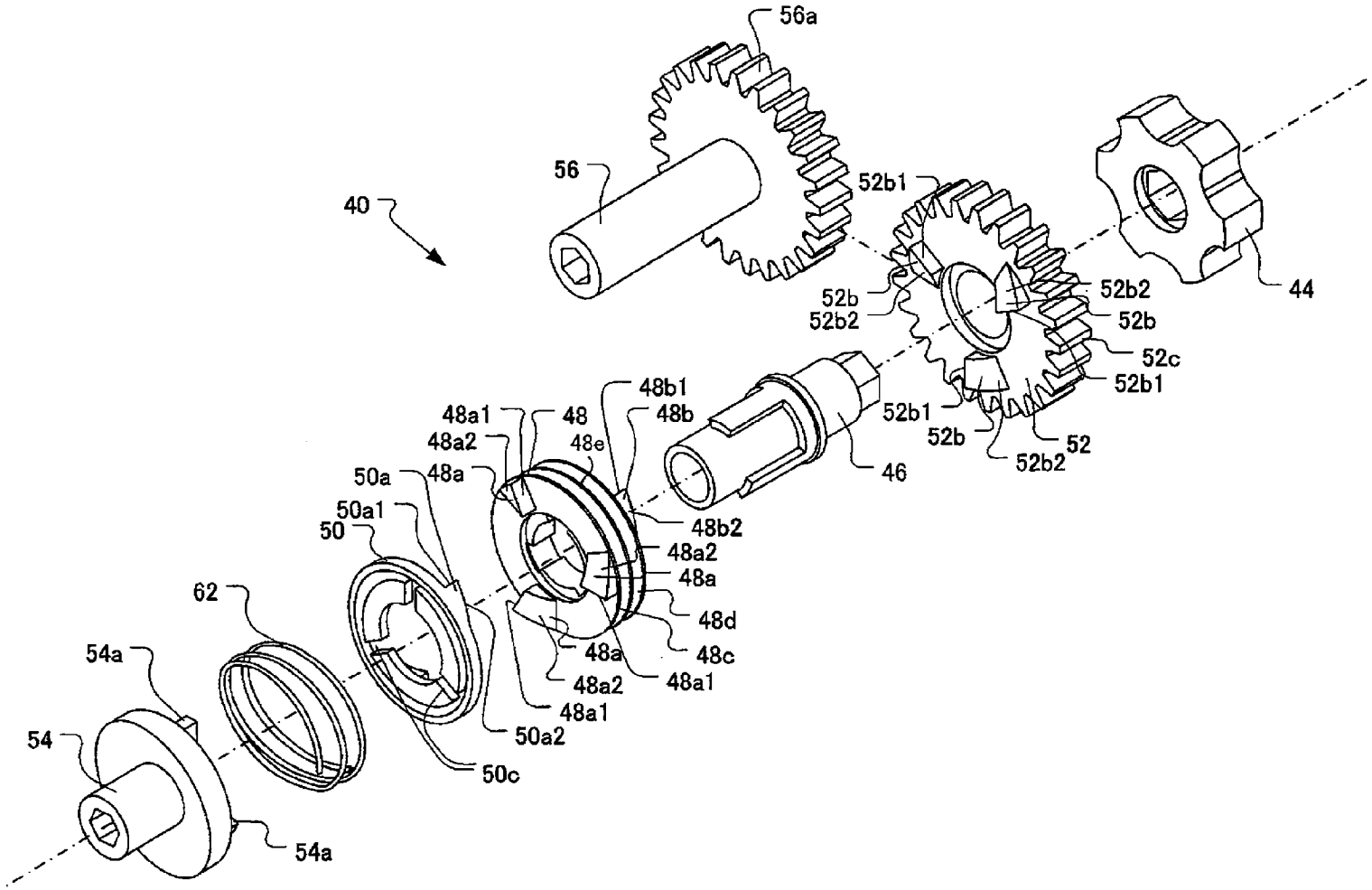
FIG. 4 is an exploded perspective view of an operation device of the blind according to the present invention.
Figure 5:
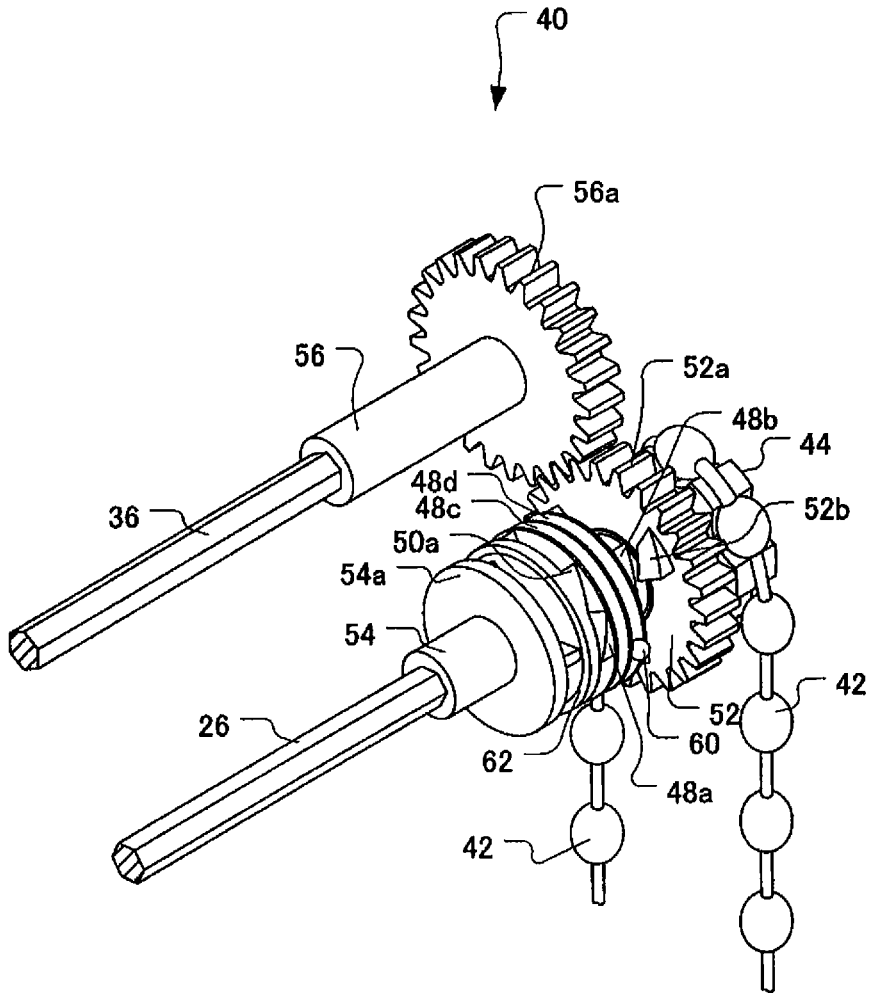
FIG. 5 is a perspective view of the operation device of the blind according to the present invention.

The operating unit 40 is described hereinafter in detail with reference to FIGS. 3 to 5. The operation unit 40 generally includes an endless operating cord 42, a pulley 44 over which the operating cord 42 is wound, an operating shaft 46 connected with the pulley 44 to rotate together with the pulley 44, a clutch 48 provided on the operating shaft 46, first and second transmission members 50 and 52 also provided on the operating shaft 46, first and second driving shafts 54 and 56 engaged with the first and second transmission members 50 and 52, and a case 58 fixed to the head box 10.

The operating shaft 46 has a one end that is inserted into the pulley 44 so as not to rotate relative to the pulley 44 and extends in the longitudinal direction of the head box 10, such that the operating shaft 46 cannot axially move with respect to the case 58. The second transmission member 52, the clutch 48, and the first transmission member 50 are provided on the operating shaft 46, in this order from the pulley 44. The operating shaft 46 penetrates the second transmission member 52 and the first transmission member 50 to be relatively rotatable whereas it penetrates the clutch 48 not to be relatively rotatable. Further, the clutch 48 and the first transmission member 50 are axially slidable with respect to the operating shaft 46 in the case 58.

Protrusions 48*a* and 48*b* axially protruding at several positions (three positions in the example shown in the figures) are circumferentially formed at equi-angular interval on both axial sides of the clutch 48. The protrusions 48*a* and 48*b* respectively have flat surfaces 48*a*1 and 48*b*1 perpendicular to the surface perpendicular to the axial direction and ramped surfaces 48*a*2 and 48*b*2 inclined with respect to the surface perpendicular to the axial direction.

Further, two grooves i.e. a first groove 48*c* and a second groove 48*d* extending in a ring shape are formed axially adjacent to each other on the outer circumferential surface of the clutch 48. A couplers 60 engaged in a recession 58*a* formed on the case 58 can be fitted in the first or second groove 48*c* and 48*d*. The coupler 60 is always pressed toward the clutch 48 by a leaf spring 64 (see FIG. 6) and the like and can be moved from one groove 48*c* or 48*d* to the other groove 48*d* or 48*c* against the pressure of the leaf spring across an interface 48*e* radially protruding between the adjacent grooves 48*c* and groove 48*d* while the clutch 48 is sliding on the operating shaft 46.

Protrusions 50*a* and 52*b* axially protruding to be engaged with the protrusions 48*a* and 48*b* of the clutch 48 depending on the rotational direction of the clutch 48 are formed at equi-angular interval circumferentially at several positions (three positions in the example shown in the figures) on the surfaces of the first transmission member 50 and the second transmission member 52 which face the clutch 48. The protrusions 50*a* and 52*b* respectively have flat surfaces 50*a*1 and 52*b*1 perpendicular to the surface perpendicular to the axial direction and ramped surfaces 50*a*2 and 52*b*2 inclined with respect to the surface perpendicular to the axial direction.

Engaging holes 50*c* are formed axially through the first transmission member 50 at equi-angular interval circumferentially at several positions and engaging protrusions 54*a* engaged in the engaging holes 50*c* are formed on the first driving shaft 54. Further, a spring 62 is disposed outside the engaging protrusions 54*a*, between the first transmission member 50 and the first driving shaft 54. Therefore, the first transmission member 50 is unrotatably connected to the first driving shaft 54 because of engagement of the engaging protrusions 54*a* into the engaging holes 50*c*, and is be axially slidable such that a gap between the first transmission member 50 and the first driving shaft 54 is variable by the spring 62. Further, the first driving shaft 54 is connected to the first driving shaft 26 to rotate in an integral manner with the first driving shaft 26.

A gear 52*c* is formed on the outer circumferential surface of the second transmission member 52 and the gear 52*c* is in engagement with a gear 56*a* formed on the outer circumferential surface of the second driving shaft 56. The second driving shaft 56 is disposed in parallel with the first driving shaft 54 and connected to the second driving shaft 36 to rotate in an integral manner with the second driving shaft 36.

The operation of the operating unit 40 is described hereinafter with reference to FIGS. 6*a* to 6*c*.

Now, it is considered to operate the first lifting/lowering cord 22 by rotating the first driving shaft 26. To this end, the indoor side (front side) of the operating cord 42 is pulled down.

The rotation of the pulley 44 is then transmitted to the operating shaft 46 and the clutch 48. If the state is one shown in FIG. 6*a*, the clutch 48 and the first transmission member 50 have been in engagement with each other, the protrusions 48*a* of the clutch 48 and the protrusions 50*a* of the first transmission member 50 have been in engagement with each other, and the protrusions 48*b* of the clutch 48 and the protrusions 52*b* of the second transmission member 52 have been disengaged. Further, the coupler 60 is fitted in the second groove 48*d* of the clutch 48 such that the position of the clutch 48 is maintained there.

Therefore, the rotational force of the clutch 48 is transmitted to the first transmission member 50, but not to the second transmission member 52, and therefore the rotation of the pulley 44 is transmitted to the first driving shaft 26 through the operating shaft 46, the clutch 48, the first transmission member 50, and the first driving shaft 54. Since the rotational direction of the pulley 44 and the operating shaft 46 is the direction in which the flat surfaces 48*a*1 of the protrusions 48*a* of the clutch 48 come in contact with the flat surfaces 50*a*1 of the protrusions 50*a* of the first transmission member 50, in FIG. 6*a*, the engagement of the clutch 48 and the first transmission member 50 is maintained and rotation is transmitted from the clutch 48 to the first transmission member 50, the first driving shaft 54, and the first driving shaft 26.

In this way, the first lifting/lowering cord 22 is wound around the first winding drum 24 by the rotation transmitted to the first driving shaft 26 such that the first shield 14 can be lifted. When the operation of the operating cord 42 is stopped, the rotation of the first driving shaft 26 in the unwinding direction of the first lifting/lowering cord 22 is restricted by the first stopper 27. When the first driving shaft 26 is desired to be allowed to rotate in the unwinding direction of the first lifting/lowering cord 22 by the first stopper 27, the first driving shaft 26 is slightly rotated in the winding direction of the first lifting/lowering cord 22 by slighting pulling down the indoor side (front side) of the operating cord 42 so that the first stopper 27 shift its state. Accordingly, the first lifting/lowering cord 22 is unwound from the winding drum 24, such that the first shield 14 can be lowered by its own weight. Meanwhile, such a first stopper 27 that shifts its state, as described above, has been well-known.

During lowering of the first shield 14, the rotation of the first driving shaft 26 is transmitted to the pulley 44 through the first driving shaft 54, the first transmission member 50, the clutch 48, and the operating shaft 46 so that the indoor side of the operating cord 42 is moved up. The rotational direction of the first driving shaft 26 is the direction in which the flat surfaces 50*a*1 of the protrusions 50*a* of the first transmission member 50 come in contact with the flat surfaces 48*a*1 of the protrusions 48*a* of the clutch 48 in FIG. 6*a*. Therefore, the rotation is transmitted to the pulley 44 from the first driving shaft 26 so that the operating cord 42 is moved, with the clutch 48 and the first transmission member 50 kept to be engaged with each other. If an operator pulls the operating cord 42 in the opposite direction to the movement of the operating cord 42 in order to stop lowering, the indoor side of the operating cord 42 is necessarily pulled down. Therefore, the first stopper 27 shifts its state and restricts the rotation of the first driving shaft 26 in the direction in which the first lifting/lowering cord 22 is unwound, thereby stopping the first shield 14.

As described above, since the operator has only to operate to stop the movement of the operating cord 42 in order to stop lowering of the first shield 14, the operator can instantly and intuitively determine the operation direction to operate, without confusing the operation direction.

Next, it is considered to operate the second lifting/lowering cord 32 by rotating the second driving shaft 36. To this end, the outdoor side (rear side) of the operating cord 42 is pulled down.

The rotation of the pulley 44, which is an opposite direction to that described above, is then transmitted to the operating shaft 46 and the clutch 48. In this process, since the first transmission member 50 cannot rotate in the direction the same as the clutch 48 by the operation of the first stopper 27, from the state shown in FIG. 6*a*, the ramped surfaces 48*a*2 of the protrusions 48*a* of the clutch 48 come in slide contact with the ramped surfaces 50*a*2 of the protrusions 50*a* of the first transmission member 50 and the clutch 48 is pushed toward the second transmission member 52 by the first transmission member 50 such that the clutch 48 axially slides to the position where the clutch 48 can be engaged with the second transmission member 52. As the clutch 48 axially slides, the coupler 60 fitted in the second groove 48*d* is fitted into the first groove 48*c* across the interface 48*e* such that the clutch 48 is firmly maintained at the position where the clutch 48 is engaged with the second transmission member 52.

Figures 6, 6A, 6B, 6C:
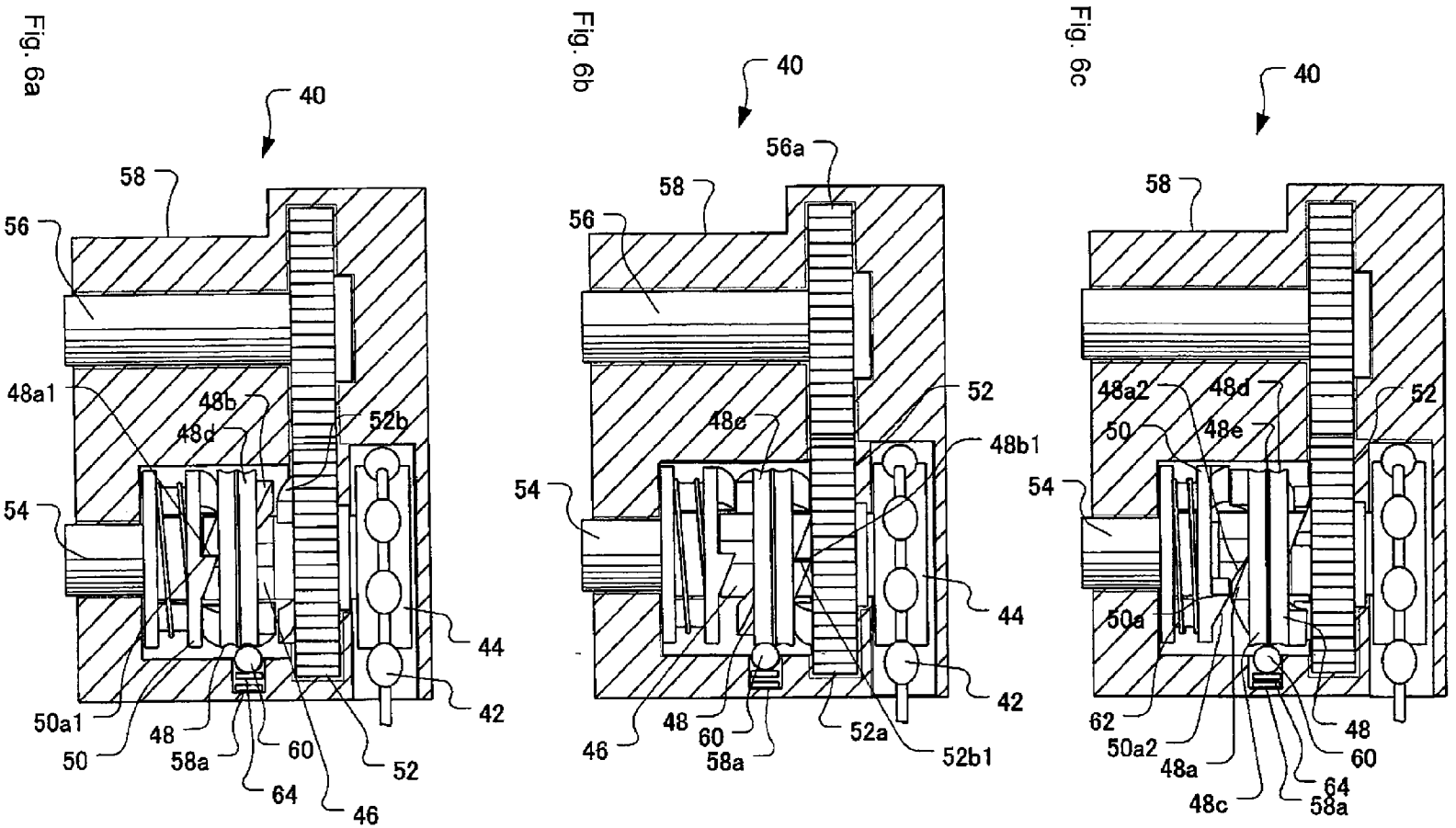
FIG. 6*a* is a partial cross-sectional view showing a state where a clutch is in engagement with a first transmission member.
FIG. 6*b* is a partial cross-sectional view showing a state where the clutch is in engagement with a second transmission member.
FIG. 6*c* is a partial cross-sectional view showing a state where the clutch is at a neutral position between the first transmission member and the second transmission member.

Subsequently, the state shown in FIG. 6*b* is obtained by continuously pulling down the outdoor side of the operating cord 42.

When the state shown in FIG. 6*b* is realized, the clutch 48 and the second transmission member 52 are engaged with each other and the protrusions 48*b* of the clutch 48 and the protrusions 52*b* of the second transmission member 52 are engaged with each other, whereas the protrusions 48*a* of the clutch 48 and the protrusions 50*a* of the first transmission member 50 are disengaged.

Therefore, the rotational force of the clutch 48 is transmitted to the second transmission member 52, but not to the first transmission member 50, and the rotation of the pulley 44 is transmitted to the second driving shaft 36 through the operating shaft 46, the clutch 48, the second transmission member 52, and the second driving shaft 56. Since the rotational direction of the pulley 44 and the operating shaft 46 is the direction in which the flat surfaces 48*b*1 of the protrusions 48*b* of the clutch 48 come in contact with the flat surfaces 52*b*1 of the protrusions 52*b* of the second transmission member 52, in FIG. 6*b*, the engagement of the clutch 48 and the second transmission member 52 is maintained and rotation is transmitted from the clutch 48 to the second transmission member 52, the second driving shaft 56, and the second driving shaft 36.

In this way, the second lifting/lowering cord 32 is wound around the second winding drum 34 by the rotation transmitted to the second driving shaft 36 such that the second shield 16 can be lifted. When the operation of the operating cord 42 is stopped, the rotation of the second driving shaft 36 in the unwinding direction of the second lifting/lowering cord 32 is restricted by the second stopper 37. When the second driving shaft 36 is desired to be allowed to rotate in the unwinding direction of the second lifting/lowering cord 32 by the second stopper 37, the second driving shaft 36 is slightly rotated in the winding direction of the second lifting/lowering cord 32 by slighting pulling down the outdoor side (inner side) of the operating cord 42 so that the second stopper 37 shifts its state. Accordingly, the second lifting/lowering cord 32 is unwound from the winding drum 34, such that the second shield 16 can be lowered by its own weight. Meanwhile, such a second stopper 37 that shift its state, as described above, has been well-known.

During lowering of the second shield 16, the rotation of the second driving shaft 36 is transmitted to the pulley 44 through the second driving shaft 56, the second transmission member 52, the clutch 48, and the operating shaft 46 so that the indoor side of the operating cord 42 is moved down. The rotational direction of the second driving shaft 36 is the direction in which the flat surfaces 52*b*1 of the protrusions 52*b* of the second transmission member 52 come in contact with the flat surfaces 48*b*1 of the protrusions 48*b* of the clutch 48 in FIG. 6*b*. Therefore, the rotation is transmitted to the pulley 44 from the second driving shaft 36 and the operating cord 42 is moved, with the clutch 48 and the second transmission member 52 kept to be engaged with each other. If an operator pulls the operating cord 42 in the opposite direction to the movement of the operating cord 42 in order to stop lowering, the outdoor side of the operating cord 42 is necessarily pulled down. Therefore, the second stopper 37 shifts its state and restricts the rotation of the second driving shaft 36 in the direction in which the second lifting/lowering cord 32 is unwound, thereby stopping the second shield 16.

As described above, since the operator has only to operate to stop the movement of the operating cord 42 in order to stop lowering of the second shield, the operator can instantly and intuitively determine the operation direction to operate, without confusing the operation direction.

Next, the operator pulls down the indoor side (front side) of the operating cord 42 in order to operate the first lifting/lowering cord 22 by rotating the first driving shaft 26 again.

The clutch 48 then rotates in the opposite direction to that described above, and the ramped surfaces 48*b*2 of the protrusions 48*b* of the clutch 48 come in slide contact with the ramped surfaces 52*b*2 of the protrusions 52*b* of the second transmission member 52 such that the clutch 48 is pushed toward the first transmission member 50 by the second transmission member 52 and engaged with the first transmission member 50. In this process, since the coupler 60 is fitted into the second groove 48*d* across the interface 48*e*, as shown in FIG. 6*a*, the clutch 48 is firmly maintained at the position where the clutch 48 is engaged with the first transmission member 50, and the clutch 48 and the first transmission member 50 come into the state shown in FIG. 6*a* by continuously pulling down the indoor side of the operating cord 42, and the following operations are the same as those described above when the clutch 48 and the first transmission member 50 are engaged with each other.

FIG. 6*c* shows a transition state when the operating shaft 46 axially slides in order that the clutch 48 is engaged with one of the first transmission member 50 and the second transmission member 52. When the tip ends of the protrusions 48*a* of the clutch 48 move beyond the tip ends of the protrusions 50*a* of the first transmission member 50, the first transmission member 50 is temporarily disengaged from the clutch 48 against the pressing force of the spring 62 and the clutch 48 can slide to approach the first transmission member 50 such that the tip ends of the protrusions 48*a* and 50*a* are prevented from tooth on tooth and locking with each other and the rotation and axial slide of the clutch 48 can be ensured.

As described above, the sliding direction of the clutch 48 is determined by the rotational direction of the operating shaft 46 and the clutch 48 can be engaged with a desired one of the transmission members 50 and 52, such that it is possible to switch the winding drums 24 and 34 for driving and operate different shield, by selecting the operational direction of one operating cord 42. Since the transmission members 50 and 52, to which rotation is transmitted, is switched by the axial slide of one clutch 48, the number of parts of the operating device 40 and the size for setting the operating device 40 can be reduced.

Although a roman shade blind was exemplified as the blind in the example described above, the present invention is not limited thereto and may be applied to any kinds of blinds.

Figure 7:
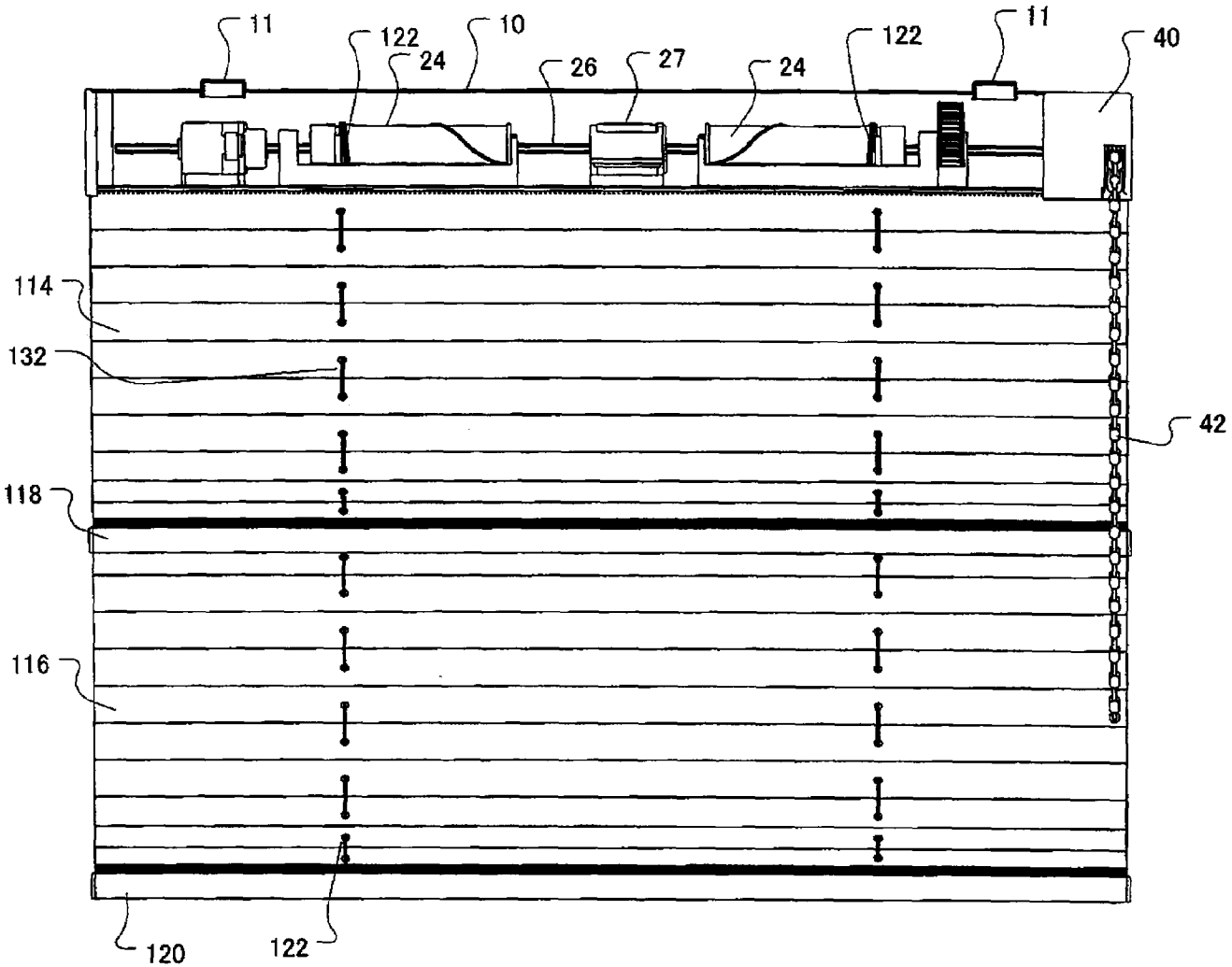
FIG. 7 is a front view of a blind according to another embodiment of the present invention.

Further, although the first shield and the second shield are completely separated in the example described above, the present invention is not limited thereto. For example, as shown in FIG. 7, a pleated screen may be configured to include a screen in which an upper end of a first shield 114 is attached to the head box 10, an intermediate bar 118 is attached to a lower end of the first shield 114, an upper end of a second shield 116 is attached to the intermediate bar 118, a lower end of the second shield 116 functions as a bottom rail 120, and the first shield 114 and the second shield 116 can be folded zigzag. In this case, a lifting/lowering cord 122 is hung from the head box 100 so as to move vertically and one end of the lifting/lowering cord 122 is connected to the bottom rail 120 with passing through each fold of the first shield 114, the intermediate bar 118, and each fold of the second shield 116. The other end of the lifting/lowering cord 122 is connected to the first winding drum 24 which is rotatably supported, to be wound around and unwound from the drum 24 in the head box 10.

Similarly, a solar radiation control cord 132 is hung from the head box 10 so as to move vertically and one end of the solar radiation control cord 132 is connected to the intermediate bar 118 with passing through each fold of the first shield 114. The other end of the solar radiation control cord 132 is connected to the second winding drum 34 which is rotatably supported, to be wound around and unwound from the drum 34 in the head box 10.

In this case, the bottom rail 120 is lifted/lowered by pulling the operating cord 42 to one direction, and as a result, both the second shield 116 and the first shield 114 can be lifted/lowered, while the intermediate bar 118 is lifted/lowered by pulling the operating cord 42 to the other direction, and as a result, the first shield 114 can be lifted/lowered. Thus, it is possible to perform different operations by differently operating one operating cord 42 in the blind with a first shield and a second shield.

Figure 8:
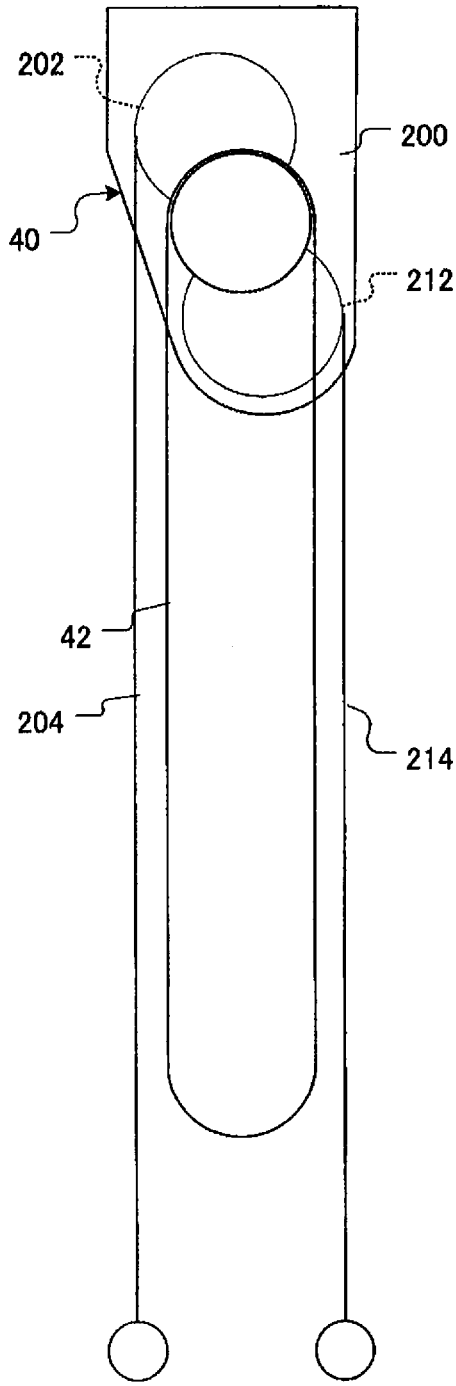
FIG. 8 is a side view of a blind according to still another embodiment of the present invention.

Further, it is also possible to apply to a roll screen as the blind. A roll screen, as shown in FIG. 8, includes two pipes i.e. a first winding pipe 202 and a second winding pipe 212, which are rotatably supported by side brackets 200 and one ends of a first shield 204 and a second shield 214 are respectively attached to the first winding pipe 202 and the second winding pipe 212 to be wound around and unwound from the pipes.

Stoppers are respectively disposed in the first winding pipe 202 and a second winding pipe 212. As the stoppers, for example, stoppers having the same configurations as those of the stoppers 27 and 37 may be used, and the first driving shaft 54 is connected with the first winding pipe 202 to be rotatable together with the first winding pipe 202 and the second driving shaft 56 is connected with the second winding pipe 212 to be rotatable together with the second winding pipe 212.

Thus, it is possible to switch from/to the winding pipes 201 to/from 212 for driving and operate different shields by selecting the operational direction of one operating cord 42.

Meanwhile, when a roll screen is used as the blind, a winding spring, which always urges the winding pipe in the winding direction of the shield, maybe disposed in the winding pipe.

In this case, it is different in that as the front side of the operating cord 42 is pulled down, the shield is lowered to the extent the pulled amount of the operating cord 42 and the shield is urged upward not by its own weight but by the biasing force of the winding spring, by slightly pulling down the front side of the operating cord 42, but the other switching operations may be applied in the same way as the above embodiment.

REFERENCE SIGNS LIST

14 First shield
16 Second shield
26 First driving shaft
27 First stopper
36 Second driving shaft
37 Second stopper
42 Operating cord
46 Operating shaft
48 Clutch
48*a*, 48*b* Protrusion
48*c* First groove
48*d* Second groove
48*e* Interface
50 First transmission member
50*a* Protrusion
52 Second transmission member
52*b* Protrusion
54 First driving shaft
56 Second driving shaft
60 Coupler
62 Spring (Ursing member)
114 First shield
116 Second shield
204 First shield
214 Second shield

The invention claimed is:

1. A blind comprising:

a first shield under a pressure that urges the first shield in any one direction of a lifting direction and a lowering direction;

a second shield under a pressure that urges the second shield in any one direction of a lifting direction and a lowering direction;

a first driving shaft rotatably supported and connected to the first shield such that a rotational direction of the first driving shaft corresponds to lifting or lowering of the first shield;

a second driving shaft rotatably supported and connected to the second shield such that a rotational direction of the second driving shaft corresponds to lifting or lowering of the second shield;

a first stopper capable of shifting between a state of allowing rotation of the first driving shaft in an urged direction of the first shield and a state of restricting the rotation of the first driving shaft; and a second stopper capable of shifting between a state of allowing rotation of the second driving shaft in an urged direction of the second shield and a state of restricting the rotation of the second driving shaft, an operating shaft capable of rotating upon receiving an operation force;

a clutch capable of rotating integrally with the operating shaft and axially sliding on the operating shaft;

a first transmission member disposed at one axial side of the clutch to transmit driving force to the first driving shaft; and a second transmission member disposed at another axial side of the clutch to transmit driving force to the second driving shaft; wherein a sliding direction of the clutch is determined by a rotational direction of the operating shaft, such that as the clutch sliding on the operating shaft becomes engaged with one of the transmission members, the rotation of the operating shaft is transmitted to either one of the driving shafts through one of the transmission members.

2. The blind according to claim 1, wherein ratchet protrusions are formed on both axial sides of the clutch, a ratchet protrusion is formed at the first transmission member, said protrusion being adapted to be engaged with the protrusion on one side of the clutch only when the clutch rotates in one direction, a ratchet protrusion is formed at the second transmission member, said protrusion being adapted to be engaged with the protrusion on another side of the clutch only when the clutch rotates in the other direction, and the protrusions of the clutch are adapted to be axially pushed in contact with the protrusion of one of the transmission members and engaged with the protrusion of the other transmission member, in accordance with the rotational direction.

3. The blind according to claim 1, wherein a plurality of grooves extending around an outer circumferential surface of the clutch are formed axially adjacent to each other, a coupler is adapted to be fitted in one of the grooves, a position of said coupler being fixed with respect to the operating shaft, and the coupler transits from one of the grooves across an interface between the adjacent grooves to be fitted into the other groove when the clutch slides on the operating shaft.

4. The blind according to claim 1, wherein at least one transmission member of the first and second transmission members is biased in the direction in which the transmission member is engaged with the clutch by an urging member.

5. The blind according to claim 1, wherein an endless operating cord is provided to apply the operational force to the operating shaft.

* * * * *